US005791535A

United States Patent [19]

Roan et al.

[11] Patent Number: 5,791,535

[45] Date of Patent: Aug. 11, 1998

[54] SOFT INFANT CARRIER

[75] Inventors: Tracy C. Roan, Springfield; Amy E. Glosh, Englewood, both of Ohio

[73] Assignee: Lisco, Inc., Tampa, Fla.

[21] Appl. No.: 556,032

[22] Filed: Nov. 9, 1995

[51] Int. Cl.[6] ..... A45F 3/04

[52] U.S. Cl. ..... 224/160; 224/153; 224/578

[58] Field of Search ..... 224/160, 159, 224/158, 161, 153, 578; D3/213, 214

[56] References Cited

U.S. PATENT DOCUMENTS

| | | | |
|---|---|---|---|
| D. 357,800 | 5/1995 | Roan et al. | D3/214 |
| 4,037,764 | 7/1977 | Almosnino | 224/6 |
| 4,149,687 | 4/1979 | Nunemacher | 224/159 |
| 4,333,591 | 6/1982 | Case | 224/160 |
| 4,402,440 | 9/1983 | Purtzer et al. | 224/160 |
| 4,428,514 | 1/1984 | Elf | 224/151 |
| 4,467,945 | 8/1984 | Schaapreld | 224/160 |
| 4,469,259 | 9/1984 | Krich et al. | 224/160 |
| 4,492,326 | 1/1985 | Storm | 224/160 |
| 4,579,264 | 4/1986 | Napolitano | 224/160 |
| 4,724,988 | 2/1988 | Tucker | 224/160 |
| 4,903,873 | 2/1990 | Poole et al. | 224/160 |
| 4,986,458 | 1/1991 | Linday | 224/160 |
| 5,020,709 | 6/1991 | Hoaglan | 224/151 |
| 5,176,102 | 1/1993 | Tracy | 119/19 |
| 5,178,309 | 1/1993 | Bicheler et al. | 224/153 |
| 5,205,450 | 4/1993 | Derosier | 224/161 |

*Primary Examiner*—Linda J. Sholl

[57] ABSTRACT

An infant carrier comprising a fabric support for the lower portion of a child. The support has an interior component and an exterior component. The support has a closed lower end with leg holes and an open upper end. The support further has vertical openings along the lateral side thereof extending between the upper edges of the leg holes and the open upper end with associated separable fasteners to selectively open and close the vertical openings. A pair of laterally disposed fasteners are provided on the exterior component of the carrier. Each fastener extends from a lower position adjacent to an upper edge of an associated leg hole to a location at the upper opening. A pair of shoulder straps have exterior ends and interior ends secured to the rear face of the support. The straps extend upwardly and outwardly from the carrier and are positionable over the shoulders of a child care provider with an inverted essentially trapezoidal-shaped yoke which has an upper wide end secured to the exterior ends of the straps and with a lower narrow end having a fastener with an associated backstrap secured at its free ends to the rear portion of the carrier and a short strap coupled at its lower end to a central extent of the horizontal strap and with its upper end threadedly received in the bracket on the yoke.

3 Claims, 4 Drawing Sheets

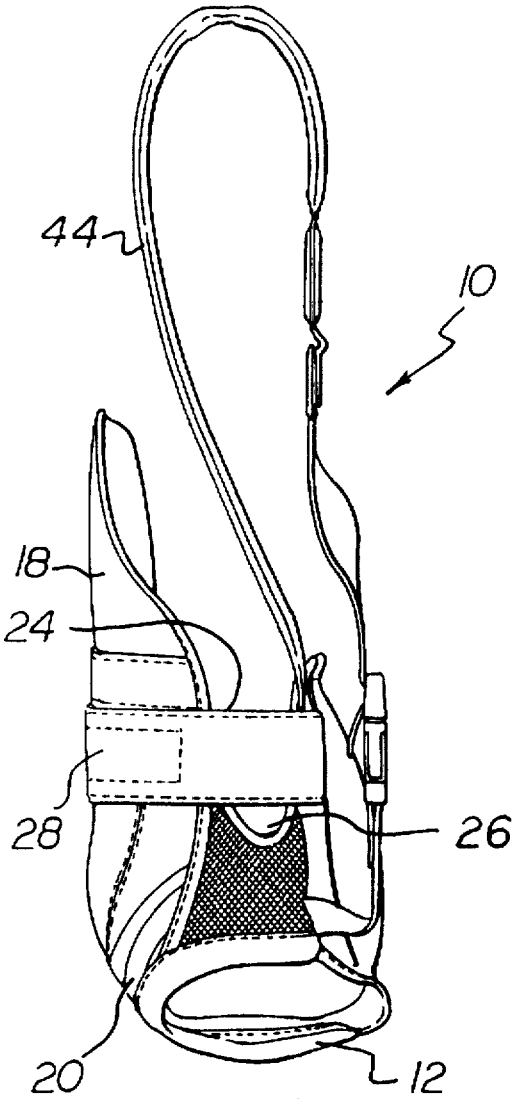
FIG. 5
FIG. 3
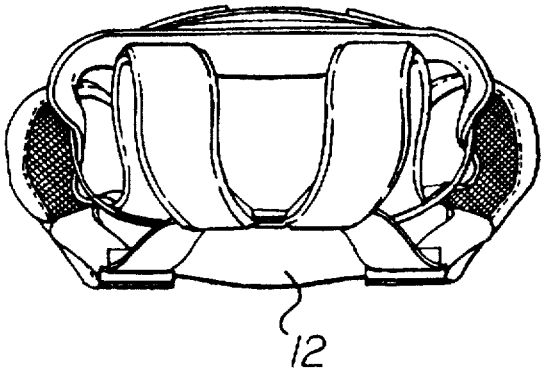
FIG. 4
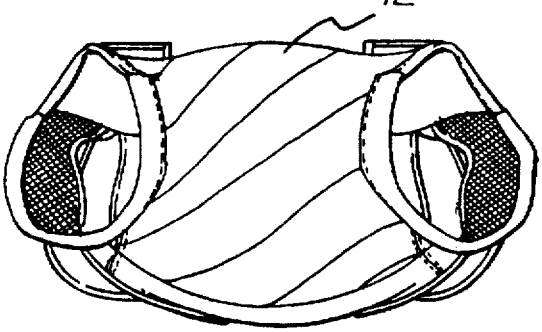

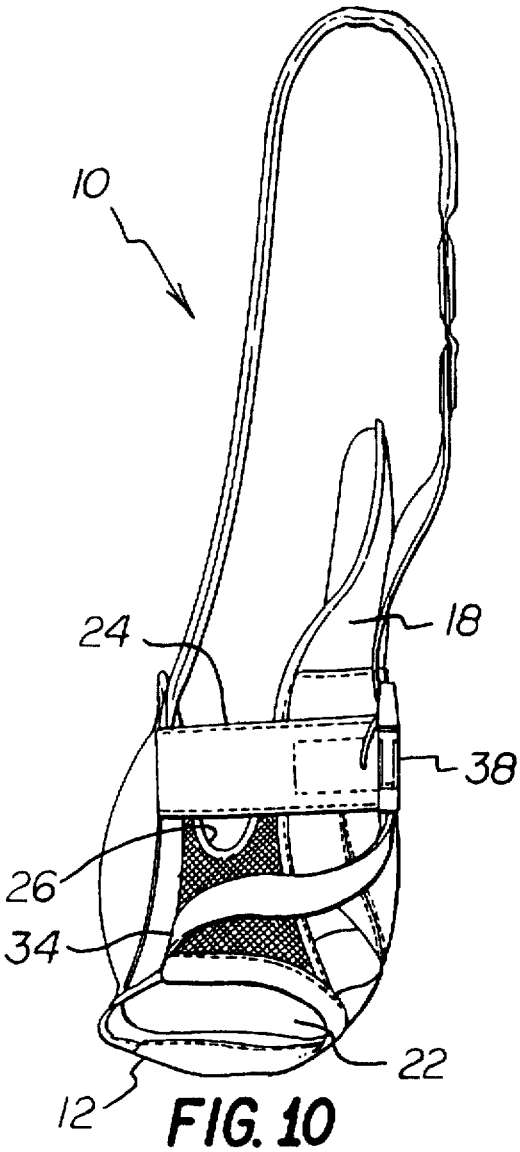
FIG. 10
FIG. 8
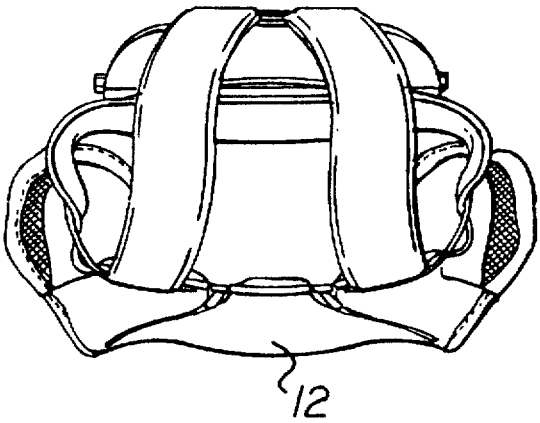
FIG. 9
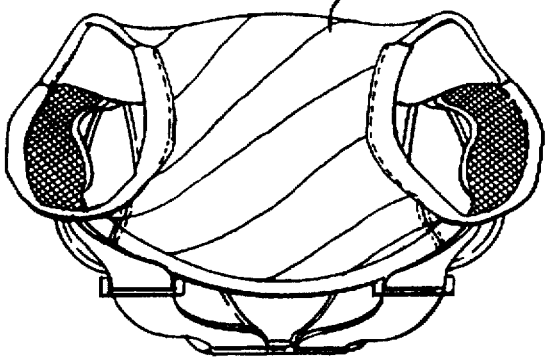

SOFT INFANT CARRIER

BACKGROUND OF THE INVENTION

1. Field of the Invention

The present invention relates to a soft infant carrier and more particularly pertains to supporting a child on the front or back of a child care provider either facing inwardly or outwardly through various methods and apparatuses.

2. Description of the Prior Art

The use of infant carriers is known in the prior art. More specifically, devices heretofore devised and utilized for the purpose of carrying small juveniles, children and infants are known to consist basically of familiar, expected and obvious structural configurations, notwithstanding the myriad of designs encompassed by the crowded prior art which have been developed.

By way of example, the prior art discloses in U.S. Pat. No. 4,149,687 to Nunemacher, discloses a baby pouch. U.S. Pat. No. 4,333,591 to Case, discloses a baby backpack sack. U.S. Pat. No. 4,402,440 to Purtzer et al., discloses an infant carrier. U.S. Pat. No. 4,428,514 to Elf, discloses an infant carrier. U.S. Pat. No. 4,467,945 to Schaapveld, discloses a baby carrier. U.S. Pat. No. 4,469,259 to Krich et al., discloses a baby carrier. U.S. Pat. No. 4,492,326 to Storm, discloses a sling-type infant carrier. U.S. Pat. No. 4,579,264 to Napolitano, discloses a baby carrying device. U.S. Pat. No. 4,724,988 to Tucker, discloses an infant carrier. U.S. Pat. No. 4,903,873 to Poole et al., discloses an infant carrier for use in an aqueous environment. U.S. Pat. No. 4,986,458 to Linday, discloses an infant carrier. U.S. Pat. No. 5,020,709 to Hoaglan, discloses a convertible child carrier. U.S. Pat. No. 5,176,102 to Tracy discloses a pet carrier. U.S. Pat. No. 5,178,309 to Bicheler et al., discloses an infant carrier and harness combination. U.S. Pat. No. 5,205,450 to Derosier, discloses a child carrier. U.S. Pat. No. Des. 357,800 to Roan et al., discloses a soft baby carrier. Lastly, U.S. Pat. No. 4,037,764 to Almosnino et al., discloses a child carrier.

Therefore, it can be appreciated that there exists a continuing need for new and improved soft infant carrier which can be used for supporting a child on the front or back of a child care provider either facing inwardly or outwardly. In this regard, the present invention substantially fulfills this need.

SUMMARY OF THE INVENTION

In view of various disadvantages inherent in the known types of infant carriers now present, the present invention provides an improvement. As such, the general purpose of the present invention, which will be described subsequently in greater detail, is to provide a new and improved soft infant carrier which maintains the advantages of the prior art and provides improvements thereover.

To attain this, the present invention essentially comprises a new and improved soft infant carrier for supporting a child on the front or back of a child care provider either facing inwardly or outwardly comprising, in combination, a flexible fabric support for the lower portion of a child. The support has an interior component and an exterior component and an integrally formed upper backrest extending upwardly from the interior component. The support has a closed lower end with leg holes and an open upper end for the passage of the child to and from the support. The support has vertical openings along the lateral side thereof extending between the upper edges of the leg holes and the open upper end with associated separable fasteners to selectively open and close the vertical openings. A pair of laterally disposed zippers on the exterior component of the carrier are provided. Each zipper extends from a lower position adjacent to an upper edge of an associated leg hole to a location on the upper periphery thereof at the upper opening. The zippers are oriented at a diagonal with their upper ends closer together and their lower ends spaced greater adjacent to the vertical openings. A waist belt has two portions. Each portion has an inner end secured to the rear face of the support adjacent to the lower ends of the vertical openings and with exterior ends having co-actable fasteners. The waist belt is adapted to be received around the waist of a child care provider supporting the carrier. A pair of shoulder straps have interior ends secured to the rear face of the support adjacent to a central extent thereof. The straps extend upwardly and outwardly from the carrier and positionable over the shoulders of a child care presenter with an inverted essentially trapezoidal-shaped yoke having its wide end secured to the outboard ends of the straps and with a lower end having a fastener with an associated backstrap secured at its free ends to the rear portion of the carrier adjacent to the upper ends of the vertical openings and short strap coupled at its lower end to a central extent of the horizontal strap and its upper end threadedly received in the bracket on the yoke for adjustment purposes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to support a small juvenile, child or infant on a parent or other child care provider in a more safe, comfortable and convenient manner.

It is a further object of the present invention to facilitate a child care provider to support an infant or other occupant in a carrier on the back or front of the child care provider with the child facing either inwardly or outwardly.

It is a further object of the present invention to simplify and strengthen the shoulder strap arrangement of a soft infant carrier through the use of an inverted trapezoidal shape yoke with the upper end coupled to the shoulder straps and the lower end coupled formed with a single buckle for adjustable attachment to a lower single strap.

It is a further object of the present invention to provide a pair of sliding fasteners on the exterior surface of the fabric support of an infant carrier, with the sliding fasteners being angled with respect to a center line to facilitate the entrance or exit of the infant from the support.

Lastly, it is an object of the present invention to provide a new and improved infant carrier comprising a fabric support for the lower portion of a child. The support has an interior component and an exterior component. The support has a closed lower end with leg holes and an open upper end. The support further has vertical openings along the lateral side thereof extending between the upper edges of the leg holes and the open upper end with associated separable fasteners to selectively open and close the vertical openings. A pair of laterally disposed fasteners are provided on the exterior component of the carrier. Each fastener extends from a lower position adjacent to an upper edge of an associated leg hole to a location at the upper opening. A pair of shoulder straps have exterior ends and interior ends secured to the rear face of the support. The straps extend upwardly and outwardly from the carrier and are positionable over the shoulders of a child care provider with an inverted essentially trapezoidal-shaped yoke which has an upper wide end secured to the exterior ends of the straps and with a lower narrow end having a fastener with an associated backstrap secured at its free ends to the rear portion of the carrier and a short strap coupled at its lower end to a central extent of the horizontal strap and with its upper end threadedly received in the bracket on the yoke.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 1 through 5 are front, rear, side, top and bottom elevational views of the preferred embodiment of the preferred embodiment of the soft infant carrier constructed in accordance with the principles of the present invention with the shoulder straps oriented to allow the child to face toward the child care provider.

FIGS 6 through 10 are front, rear, side, top and bottom elevational views of the preferred embodiment of the preferred embodiment of the soft infant carrier constructed in accordance with the principles of the present invention but with the shoulder straps oriented to allow the child to face away from the child care provider.

Similar reference characters refer to similar parts throughout the several views of the drawings.

DESCRIPTION OF THE PREFERRED EMBODIMENT

Figure 1:
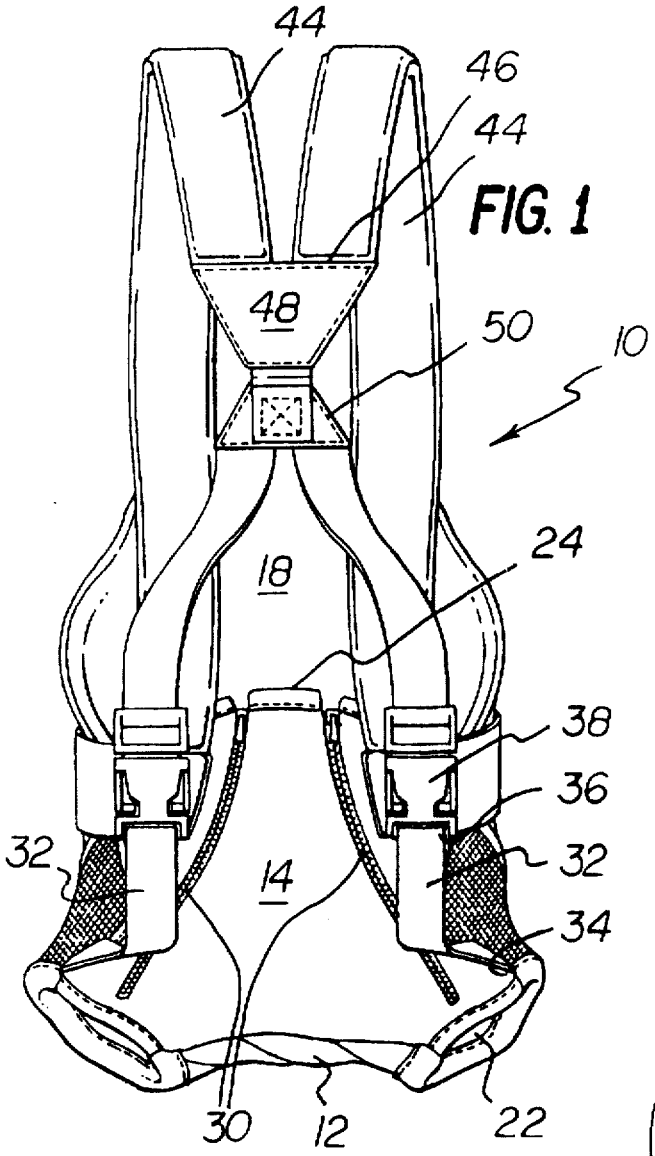
Figure 2:
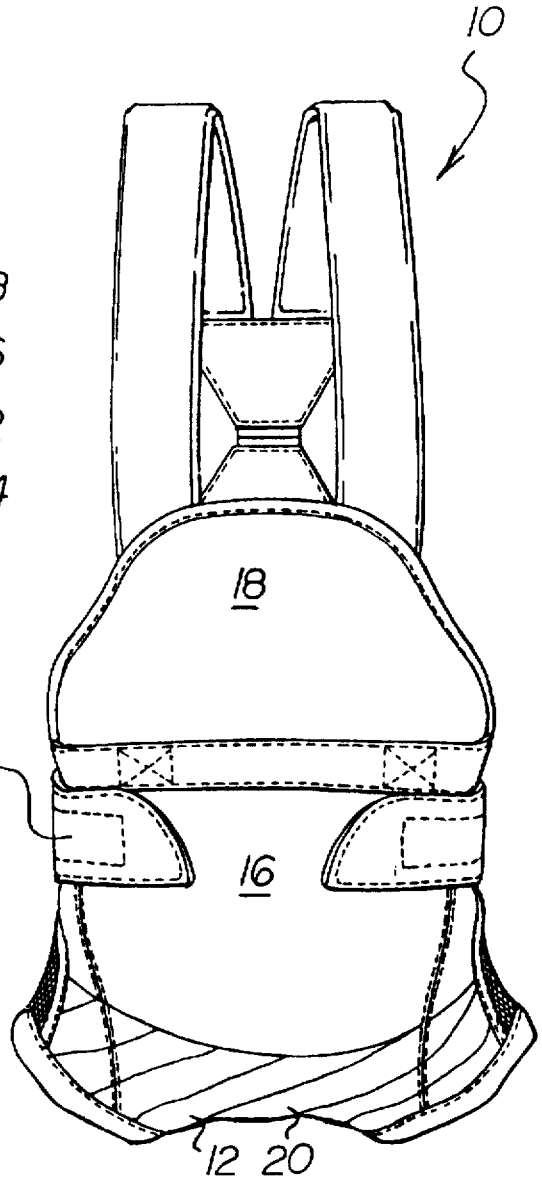
Figure 6:
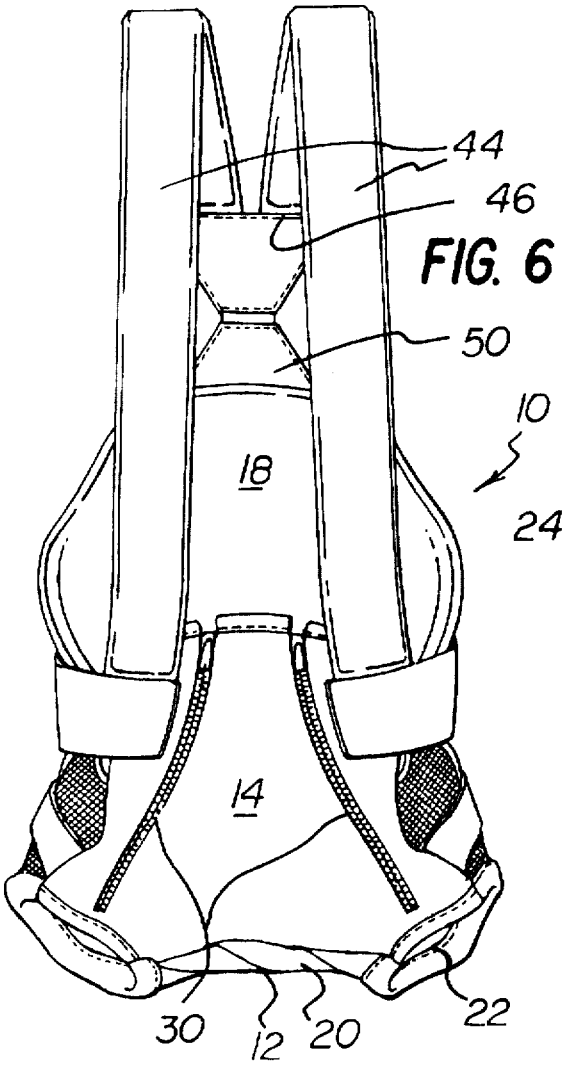
Figure 7:
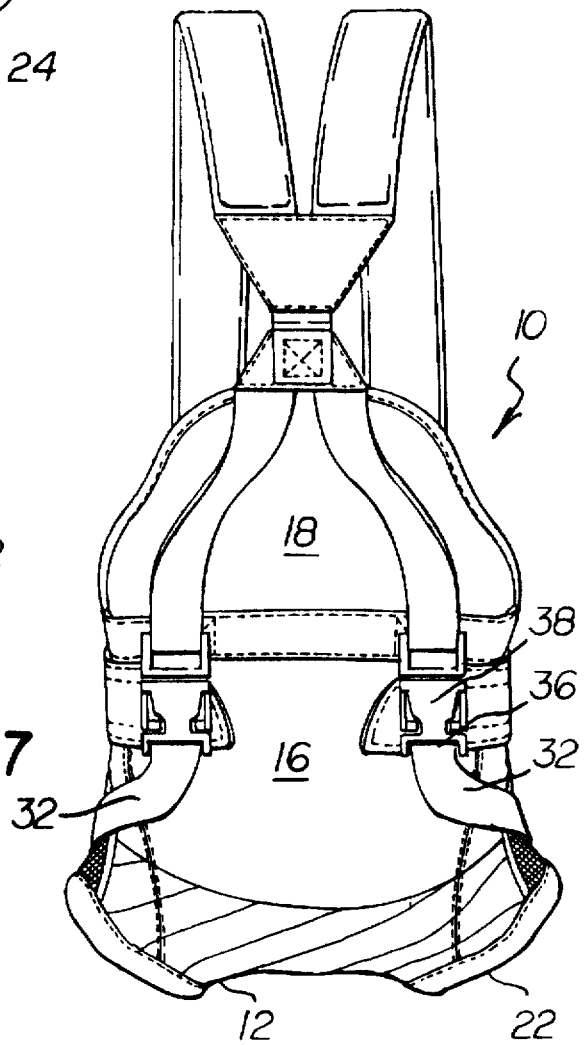

With reference now to the drawings, and in particular to FIG. 1 thereof, a new and improved soft infant carrier embodying the principles and concepts of the present invention and generally designated by the reference numeral 10 will be described.

The present invention, the new and improved soft infant carrier is comprised of a plurality of components. Such components in their broadest context include a flexible fabric support, a pair of laterally disposed zippers, a waist belt and a pair of shoulder straps. Such components are individually configured and correlated with respect to each other so as to attain the desired objective.

More specifically, the present invention is in effect a carrier system 10. It is configured to be worn on the front or back of a child care provider. In either orientation, the supported infant may be facing inwardly toward the child care provider or outwardly away from the child care provider. The central component of the system 10 of the present invention is a flexible fabric support 12. Such support is for receiving and supporting the lower portion of an infant, child or small juvenile. Such support is formed to have an interior component 14 and an exterior component 16. In addition, the support has an integrally formed upper backrest 18. Such backrest extends upwardly from the interior component. The support is configured to have a closed lower end 20. Within the lower end are a pair of leg holes 22. In addition, the support is formed with an open upper end 24. Such upper end is for the passage of a child to or from the support.

To assist in placing or removing a child with respect to the support, the support is formed to have a pair of parallel vertical openings 26. Such openings are of a similar configuration and are located along the lateral side of the support. They extend between the upper edges of the leg holes and the open upper end. Separable fasteners 28 are located with respect to each vertical opening. Such fasteners function to selectively open and close the vertical opening.

Additional utility is provided to the fabric support through the use of a pair of laterally disposed fasteners, preferably sliding fasteners such as zippers 30. Such zippers are located on the exterior component of the carrier. Each zipper extends from a lower position adjacent to an upper edge of an associated leg hole to a location on the upper periphery of the support. Such is located at the upper opening. The zippers form an angle between about 10 degrees and 30 degrees with respect to the vertical centerline of the carrier. This arrangement greatly facilitates the putting in or taking out of the infant with respect to the support.

The zippers are preferably oriented on a diagonal. Their upper ends are closer together at the center of the open upper end. Their lower ends are spaced greater than the upper end adjacent to their vertical openings.

The next component of the system are short shoulder straps 32. Each such shoulder strap has an interior end 34 secured to the front face of the support adjacent to the lower ends of the vertical openings. The exterior ends 36 of the belt portions have co-actable lower fasteners 38. The fasteners may be directed forwardly or rearwardly as a function of the desired orientation, forwardly or rearwardly, of the carried child.

Lastly provided as a component of the system are a pair of long shoulder straps 44. Such shoulder straps have interior ends 46. The interior ends are secured to the rear face of the support. Such securement is at a location adjacent to the central extent of the rear interior component. The straps then extend upwardly and outwardly from the carrier and are positioned over the shoulders of the child care provider. At such points, the outboard ends of the straps are coupled to a larger essentially inverted trapezoidal-shaped yoke 48. Such yoke has its wide end secured to the outboard ends of the shoulder straps. The lower end of the yoke coupled to a trapezoidal shaped yoke 50. Intermediate straps 52 depend from the smaller trapezoidal yoke with upper fasteners 54 at the lower ends thereof. When the lower fasteners are located over the front of the seat and child, the child will face the child care provider. Note FIG. 5. When the lower fasteners are located over the back of the seat and child, the child will face away from the child care provider. Note FIG. 10. Such an arrangement allows for greater simplicity and with increased strength and stability due to its arrangement of straps and connectors.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A soft infant carrier for supporting a child on the front or back of a child care provider either facing inwardly or outwardly comprising, in combination:

a flexible fabric support for the lower portion of a child, the support having an interior component and an exterior component and an integrally formed upper backrest extending upwardly from the interior component, the support having a closed lower end with leg holes and an open upper end for the passage of the child to and from the support, the support having vertical openings along the lateral side thereof extending between the upper edges of the leg holes and the open upper end with associated separable fasteners to selectively open and close the vertical openings;

a pair of laterally disposed zippers on the exterior component of the carrier each zipper extending from a lower position adjacent to an upper edge of an associated leg hole to a location on the upper periphery thereof at the upper opening, the zippers being oriented at a diagonal with their upper ends closer together and their lower ends spaced greater adjacent to the vertical openings forming an angle of between about 10 and 30 degrees;

short shoulder straps, each strap having an inner end secured to the rear face of the support and with exterior ends having co-actable lower fasteners; and a pair of long shoulder straps having interior ends secured to the rear face of the support adjacent to a central extent thereof, the straps extending upwardly and outwardly from the carrier and positionable over the shoulders of a child care presenter with an inverted essentially trapezoidal-shaped yoke having its wide end secured to the outboard ends of the straps and with a lower end with a smaller trapezoidal shaped member and two intermediate straps depending therefrom with upper fasteners separably coupled to the lower fasteners either in front of or to the rear of the child being carried.

2. An Infant carrier comprising:

a fabric support for the lower portion of a child, the support having an interior component and an exterior component, the support having a closed lower end with leg holes and an open upper end, the support having vertical openings along the lateral side thereof extending between the upper edges of the leg holes and the open upper end with associated separable fasteners to selectively open and close the vertical opening;

a pair of laterally disposed fasteners on the exterior component of the carrier, each fastener extending from a lower position adjacent to an upper edge of an associated leg hole to a location at the upper opening;

short shoulder straps, each strap having an inner end secured to the rear face of the support and with exterior ends having co-actable lower fasteners; and a pair of long shoulder straps having interior ends secured to the rear face of the support adjacent to a central extent thereof, the straps extending upwardly and outwardly from the carrier and positionable over the shoulders of a child care presenter with a first yoke having a wide end secured to the outboard ends of the straps, and intermediate straps interconnected to the first yoke, with the intermediate straps having upper fasteners separably coupled to the lower fasteners either in front of or to the rear of the child being carried.

3. The apparatus as set forth in claim 2 wherein the fasteners diverge from the centerline of the carrier at between about 10 and 30 degrees.

* * * * *